United States Patent [19]

Ortel

[11] Patent Number: 4,621,765

[45] **Date of Patent: * Nov. 11, 1986**

[54] TRAY STACKING WIRE

[75] Inventor: Stanley G. Ortel, Buffalo, N.Y.

[73] Assignee: Better Wire Products, Inc., Buffalo, N.Y.

[ * ] Notice: The portion of the term of this patent subsequent to Oct. 14, 1997 has been disclaimed.

[21] Appl. No.: 196,329

[22] Filed: Oct. 14, 1980

Related U.S. Application Data

[62] Division of Ser. No. 934,216, Aug. 16, 1978, Pat. No. 4,227,642.

[51] Int. Cl.[4] ..... B65D 5/46; B65D 21/02

[52] U.S. Cl. ..... 229/52 AW; 206/510; 206/821; 229/167; 229/915

[58] Field of Search ... 229/52 AW, 34 HW, DIG. 11; 206/509, 515, 821

[56] References Cited

U.S. PATENT DOCUMENTS

| | | | |
|---|---|---|---|
| 2,612,309 | 9/1952 | Potts | 229/52 AW |
| 2,788,934 | 4/1957 | Cain | 229/52 AW |
| 2,896,835 | 7/1959 | Burkhardt | 229/DIG. 11 |
| 2,921,730 | 1/1960 | Brebner | 229/52 AW |
| 2,944,722 | 7/1960 | Dahlhauser | 229/52 AW |
| 2,998,908 | 7/1961 | Harvey | 229/52 AW |
| 3,026,008 | 3/1962 | Bertram | 229/52 AW |
| 3,106,332 | 10/1963 | Dieguez | 229/DIG. 11 |
| 3,750,936 | 8/1973 | Crane | 229/52 AW |
| 4,039,119 | 8/1977 | Crane | 229/34 HW |
| 4,058,249 | 11/1977 | Buch | 229/DIG. 11 |

*Primary Examiner*—George E. Lowrance

*Attorney, Agent, or Firm*—Christel, Bean & Linihan

[57] ABSTRACT

A top insertion, tray stacking wire with coplanar feet extending outwardly in opposite directions at the bottom of the wire with a prong extending laterally outward from the end of each foot at a substantial angle to the plane of the feet. The wire is held in a horizontal disposition for insertion of the feet and attached prongs into a slot aperture in the top edge of a corrugated paperboard tray and the like having a double wall construction. The wire includes a U-shaped body attached to the divergent feet wherein the legs thereof resiliently separate from one another to abut the ends of the slot aperture with the divergent wire feet projecting underneath the ends of the aperture. While the U-shaped body is being pivoted to assume a vertical orientation, the prongs bite into the corrugations of the adjacent wall, simultaneously pressing the pivoting feet into firm engagement against the wall adjacent thereto whereby the stacking wire is maintained in a firm, upright disposition. The prongs bite into the wall corrugations to a sufficient degree to enable one to carry a tray equipped with two such stacking wires, with or without a superimposed second tray when desired.

4 Claims, 6 Drawing Figures

TRAY STACKING WIRE

This is a division of application Ser. No. 934,216 filed Aug. 16, 1978, now U.S. Pat. No. 4,227,642.

BACKGROUND OF THE INVENTION

This invention relates generally to tray stacking wires as utilized generally with corrugated paperboard trays and the like. More particularly, the invention related to a unitary tray stacking wire with greatly enhanced assembly features with respect to the trays used therewith.

The prior art includes several types of tray stacking wires. U.S. Pat. No. 2,944,722 to Dahlhauser et al describes a stacking wire of the general type in which the wire is inserted upwardly through an aperture in the sidewall of a tray, with inwardly extending tips at the bottom ends of the stacking wire fitting into corresponding holes in the sidewall of the tray.

U.S. Pat. No. 3,750,936 to Crane describes a stacking wire for top insertion into a conventional corrugated paperboard container having a double wall construction. After insertion and upon lifting to a vertical position, the feet of the wire with abbreviated sharp prongs having sharp ends, bite into the container wall and become engaged therewith. However, a number of bends are necessary to prevent the sharp ends of the wire feet from penetrating through the sidewall of the container or tray.

U.S. Pat. No. 3,106,332 to Dieguez describes, in relevant part, a stacking wire quite similar to that of Crane. It operates in substantially the same way and similarly requires abbreviated sheared sharp prongs on its feet.

In summary, with respect to the prior art, a number of difficulties are encountered with respect to the several types of constructions available. Some stacking wires are adapted to be engaged in customized die cut slits of a cross or star shape in the top edge of a double wall in the tray as opposed to being adapted for engagement in an elongated slot aperture standard to the industry. However, when die cut hole slits are used, the lead ends of the mating wire must be manually sprung outwardly beyond the universal slot aperture, thereby resulting in more labor time for location and insertion than when using an open slot aperture. With respect to those stacking wires adapted for use with open slot apertures, the prior art constructions suffer from an undue number of multiple or compound bends plus reverse bends or loops. In addition, it is not uncommon for such wires to be easily knocked out of vertical orientation—resulting in a considerable disruption of the stacking function. In addition, those stacking wires having sheared sharp wire ends tend to easily penetrate the wall of a corrugated paperboard tray, at the same time endangering personnel during the handling and installation thereof. With respect to stacking wires which are inserted upwardly through a tray wall through a slot in the bottom edge thereof, the primary drawback associated therewith resides in the fact that assembly is very slow and the tray must be tipped or hung over a flat surface in order to obtain access to the open slot in the bottom edge of the tray wall one end of the tray at a time. Furthermore, the bottom feet of the stacking wire may catch on a floor or truckbed, for example, on which the trays are placed.

SUMMARY OF THE INVENTION

Accordingly, a primary object of the present invention is to provide a new, safer and improved tray stacking wire which may be assembled with a minimum amount of effort and within a corresponding minimum amount of time.

Another object of the present invention is to provide an improved tray stacking wire which firmly is maintained in a vertical disposition after assembly so that the stacking function associated therewith is not interrupted.

A further object of the present invention is to provide the aforesaid tray stacking wire which does not necessitate the use of aligned slits or holes in a tray wall or the correspondingly intricate assembly procedure associated therewith.

Still another object of the present invention is to provide a tray stacking wire which may be used with trays having double wall constructions with varying spacings between the double walls.

In summary, the present invention comprises a top insertion tray stacking wire having an inverted U-shaped body with coplanar feet extending laterally outwardly in opposite directions from the free ends of the U-shaped body. A prong extends outwardly from the end of each foot at a substantial angle with respect thereto but preferably less than 90°. The prongs lie in a plane preferably perpendicular to the plane of the U-shaped body and feet. During assembly, the legs of the U-shaped body are compressed together and positioned horizontally for insertion of the feet and prongs into a slot type aperture in the top edge of the tray—the latter being of spaced, double corrugated wall construction. Upon release, the U-shaped body separates to abut the ends of the slot aperture and upon full pivoting of the U-shaped body to a vertical disposition, the blunt ends of the prongs break into the adjacent corrugated wall. Since the prongs are preferably oriented at an oblique angle to the wall engaged, and have blunt or squared-off end faces, the prongs do not tend to fully penetrate or pierce through the wall. Instead, the prongs tend to buckle to a limited extent while engaging the corrugated wall at an oblique angle, thus increasing the surface contact of the prong ends with the wall so as to resist vertical movement of the stacking wire relative to the wall. Aforementioned buckling of the prongs to a minor degree also serves to provide a compression tension on the feet against the opposing tray wall so as to resist horizontal movement of the stacking wire after full insertion. In its preferred embodiment, the stacking wire of the present invention is also provided with locking protrusions extending outwardly, away from one another, on the lower leg ends of the U-shaped body. Such locking protrusions can be designed to coact with the ends of the diverging slot aperture so as to insure that the stacking wire is maintained in a vertical disposition.

The foregoing and other objects, advantages, and characterizing features of the present invention will become clearly apparent from the ensuing detailed description of an illustrative embodiment thereof, taken together with the accompanying drawings wherein like reference characters denote like parts throughout the various views.

DETAILED DESCRIPTION OF A PREFERRED EMBODIMENT

Figure 1:
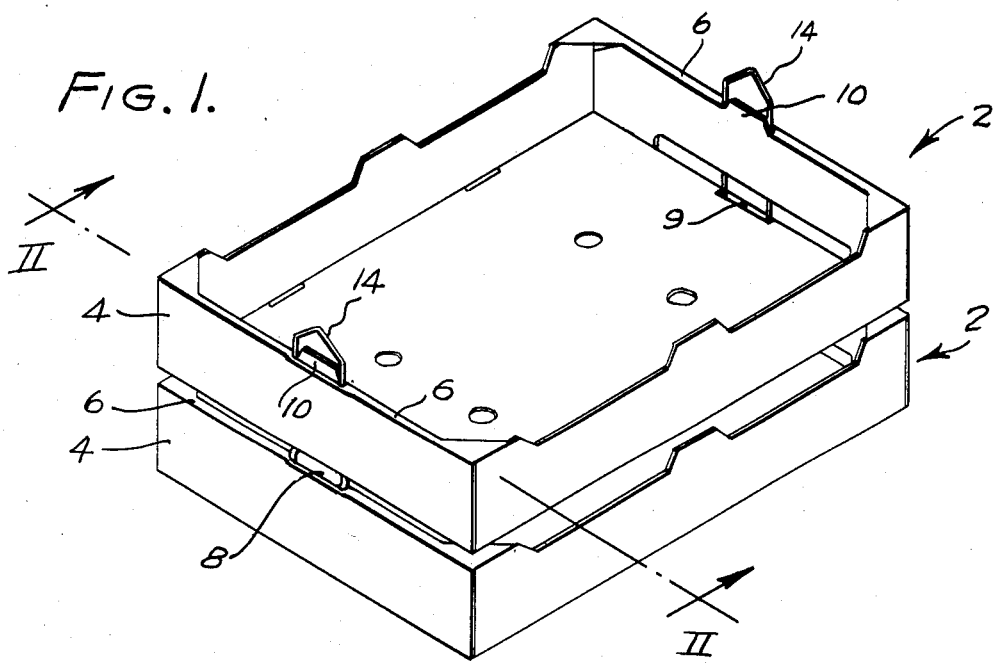
FIG. 1 is perspective view of a pair of stacking wires, embodying the present invention, attached to a tray and projecting through a superposed tray in the process of being assembled on top of the underlying tray shown.

Referring now in detail to the illustrative embodiment depicted in the accompanying drawings, there is shown in FIG. 1 trays or baskets 2, or the like, of corrugated paperboard wherein one tray is in the process of being stacked vertically on top of the other. Trays 2 include end walls 4 which comprise a double wall construction formed, for example, by folding a single sheet of corrugated material over on itself so that a top edge 6 bridges or integrally joins one wall to the other. Each top edge 6 includes a slotted type of aperture 8, generally along the top edge 6 and which may be undercut to form a tab 10 which is shown to stand upwardly from the tray. Of course, tab 10 could be formed to stand upwardly from either of the double walls or could simply be removed in its entirety. For purposes of describing this embodiment of the invention, it is to be noted in FIG. 4 and FIG. 6 that the ends of the aperture 8 are formed to diverge inwardly towards the center of the tray. The double walls 4 envelop an insertion space 12, as clearly depicted in FIGS. 3 and 5, into which the lower portion of the stacking wire 14 is inserted through the slot aperture 8. For stacking purposes, a slot 9 is formed in the bottom edge of walls 4, in alignment with slot 8, for reception of the upper portion of the stacking wire considered herein.

Figure 2:
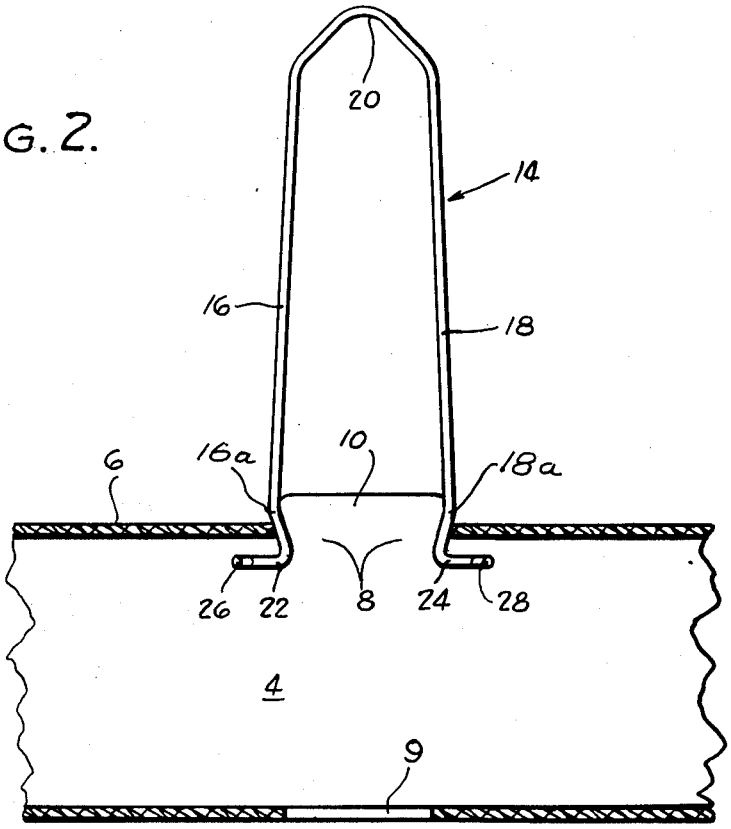
FIG. 2 is a sectional view of the stacking wire in engagement with a tray wall taken about on line II—II of FIG. 1 with the upper tray illustrated in FIG. 1 removed.

Referring to FIG. 2, stacking wire 14 is configured of a single or unitary wire piece to include spaced legs 16 and 18 joined by a hairpin shaped loop or bight portion 20 at the upper ends of the legs. The lower ends of legs 16 and 18 are shown to include feet 22 and 24 extending laterally from each respective leg and in opposite directions with respect to one another generally within the plane of the legs 16 and 18 and bight portion 20. Each of the feet 22 and 24 terminate in prongs 26 and 28 respectively, the prongs extending laterally from corresponding sides of the feet to lie in a plane disposed at a generally perpendicular angle to the plane defined by the legs 16, 18 and bight portion 20.

As shown in FIG. 2, the stcking wire 14, which is of a resilient material, is in a slightly compressed condition so that legs 16 and 18 are allowed to spring apart the full length of slot aperture 8 to abut the end edges thereof defined by the top edge 6. As to be described more fully with respect to the assembly of the stacking wire, the lower ends of the legs 16 and 18 are provided with locking protrusions **16*a* and 18*a* which extend laterally therefrom in opposite directions from one another so as to coact with the inwardly diverging end edges of the slot aperture 8. Such coaction of the protrusion 16*a* and 18*a* serves to insure that the legs 16, 18 and bight portion 20** are maintained in a substantially vertical plane.

As referred to hereinabove, by far the most significant consideration with respect to the present invention is the minimal amount of labor required to install the stacking wire described in a tray end wall. Of course, due to the stacking wires lack of complex multiple or compound bends plus reverse bends or loops, as compared to the prior art, there is a savings in material and manufacturing costs, but the primary advantage to an end user resides in the minimal assembly time. These compound bends and loops cause the most trouble when unwrapped in bulk on the ground by becoming entangled prior to insertion, as well as the difficulty referred to during insertion. Moreover, the legs must be crossed over themselves by manual compression to achieve insertion.

Figure 3:
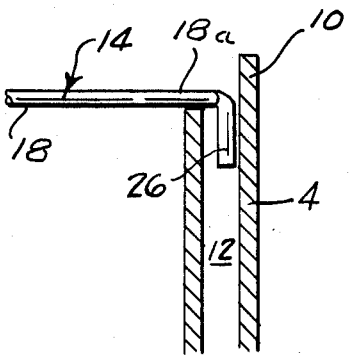
FIG. 3 is a vertical sectional view taken about on line III—III of FIG. 4.
Figure 4:
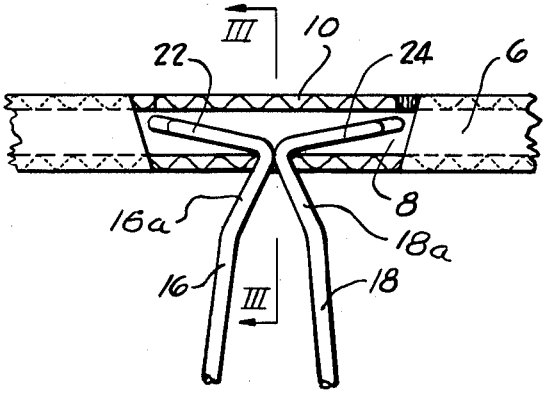
FIG. 4 is a plan view of a stacking wire positioned over a tray during its insertion into the space between its double wall construction, illustrating the first step of such insertion.

FIGS. 3 thorugh 6 illustrate the manner in which the stacking wire is attached to, or detached from, a tray having the double wall construction as referred to hereinabove. In FIGS. 3 and 4, the main body of the stacking wire, as defined by legs 16 and 18 and the intermediate bight portion 20, is in a horizontal disposition perpendicular to the tray walls 4 and extends outwardly therefrom. Necessarily, the upwardly extending tab 10 could be formed on the outer wall 4 with the main body portion of the stacking wire 14 extending inwardly towards the center of the tray without any potential interference. Of course, the tab 10 could be eliminated altogehter, thereby enabling the stacking wire to be assembled from either the inboard or outboard side of the tray without any potential interference with tab 10.

As clearly shown in FIG. 4, legs 16 and 18 are pressed together to allow feet 22 and 24 and prongs 26 and 28 to pass through the slot aperture 8 into the space 12. With the main body of the stacking wire in a horizontal disposition, prongs 26 and 28 lie in a plane parallel to the planes of the spaced walls 4. Since the feet and main body of the stacking wire are coplanar only the prongs 26 and 28 project into space 12 as viewed in FIG. 3. Such a shallow entry depth into space 12 is a distinct advantage in double wall constructions which may be partially filled with fold-up reinforcement flaps from the bottom wall or fold-in reinforcement flaps from the side wall panels. In moving to the fully assembled position illustrated in FIGS. 5 and 6, it is to be understood that as the main body of the stacking wire is initially rotated from the horizontal towards the vertical orientation, the feet 22 and 24 dip below the top edge 6 and are allowed to spring apart whereby the feet 22 and 24 project underneath the respectively associated edges of aperture 8. Upon urging the main body of the stacking wire into its fully upright position, the ends of prongs 26 and 28 increasingly bite into the adjacent wall 4. The ends of the prongs are squared off and lie in planes substantially perpendicular to the longitudinal axis of the prongs. Accordingly, the blunt end faces of the prongs do not tend to simply cut through the corrugated wall, as sharpened prong ends would, but rather "buckle" or tear into the corrugated wall at an oblique angle due to the oblique orientation of the prongs to the plane of the wall. The oblique arrangement of the prongs does provide some give or tendency to bend or torque slightly where joined to the feet, which thereby further prevents penetration through the wall while increasing surface contact with the wall material. This is the preferred arrangement as opposed to the prongs being orientated in a perpendicular manner with respect to the adjacent wall 4. In other words, feet 22 and 24 are pressed into spring tension against wall 4, thereby keeping the stacking wire firmly upright. In addition, the limited resiliency of the oblique prongs enables the stacking wire to be used with trays of double wall construction having varied spacing between the walls over a given range.

Figure 6:
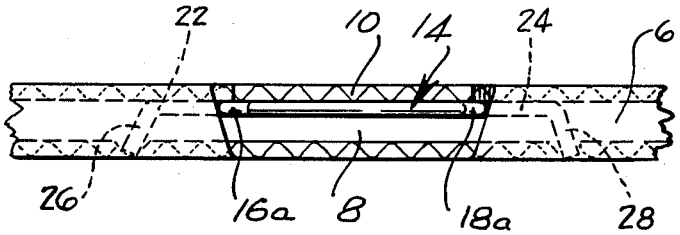
FIG. 6 is a plan view similar to FIG. 4 showing the final position of the stacking wire.

As the main body of the stacking wire is pivoted to the fully upright position, there is a slight tendency, due to the oblique nature of the prongs, for the legs 16 and 18 to slightly compress toward one another. Due to this fact, the legs 16 and 18 may not snugly fit into the beveled corners of the slot aperture as shown in FIG. 6, which corners function to insure the vertical orientation of the stacking wire. Accordingly, the outwardly extending locking protrusions 16*a* and 18*a* are provided in the preferred embodiment of the instant invention at an appropriate distance above feet 22 and 24 so as to come into snug engagement with the beveled corners on the inward side of the slot aperture so as to firmly resist any reverse pivoting of the stacking wire. As stated, a primary feature of the present invention resides in the fact that this entire assembly procedure may be accomplished with a minimal amount of labor time. Initial insertion of the prongs through aperture 8 into space 12 in uncomplicated and is followed by one smooth turning or pivoting of the wire to an upright position.

Figure 5:
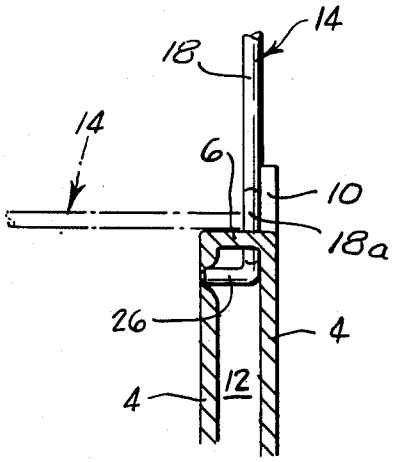
FIG. 5 is a sectional view, similar to FIG. 3, showing the final assembled position of the stacking wire.

As clearly shown in FIGS. 2 and 5, the feet 22 and 24 are normally spaced below the top edge 6 due to the pivoting motion about the ends of the prongs. The trays may be carried by the stacking wires if desired and the engagement of the prongs in the corrugated wall 4 will normally provide sufficient support. However, when the trays are carried by the stacking wires, and if the prongs should tend to tear upwardly along the wall 4, the feet 22 and 24 would eventually abut the undersurface of the top edge 6 to provide additional vertical carrying support. It is not anticipated that this would be the normal situation. In this regard, it is also within the scope of the present invention that the feet 22 and 24 could be completely eliminated with the prongs 26 and 28 depending directly from the ends of legs 16 and 18. This would involve the saving of wire material and further simplify the design for manufacturing purposes. However, it has been found that the feet 22 and 24 function to maintain the stacking wire in a vertical disposition in a more dependable manner than if they were not present.

From the foregoing, it is apparent that the objects of the present invention have been fully accomplished. As a result of this invention, an improved tray stacking wire is provided which may be assembled with an absolute minimum amount of labor time.

Having thus described and illustrated a preferred embodiment of my invention, it will be understood that such description and illustration is by way of example only and that such modifications and changes as may suggest themselves to those skilled in the art are intended to fall within the scope of the present invention as limited only by the appended claims.

I claim:

1. A unitary resilient stacking wire adapted for stacking corrugated paperboard trays and the like on top of one another, said stacking wire including a pair of legs and a bight portion with corresponding ends of said legs being joined by said bight portion into a substantially planar U-shape configuration, said legs being resiliently biased away from each other and diverging from said bight, each of the nonjoined ends of said legs terminating in a foot extending laterally from each respective leg, each said foot being unidirectional and extending in opposite directions with respect to one another and positioned substantially within the plane of said legs and bight portion, each said foot terminating in a prong extending laterally therefrom in order to permit bending thereof and positioned on the same side of the plane of said legs and said bight portion, wherein said prongs extend obliquely and in outwardly diverging relation and lie in a plane disposed at a substantial angle to the plane of said legs and said bight portion.

2. A unitary resilient stacking wire as set forth in claim 1, the end portion of each said leg, adjacent its respective foot, including an inwardly directed protrusion extending therefrom, said protusions lying substantially within the plane of said legs and said bight portion and being adapted to co-act with a tray and the like to maintain the plane of said legs and said bight portion in a vertical orientation.

3. A unitary resilient stacking wire as set forth in claim 1, each said prong terminating with an end face lying in a plane substantially perpendicular to the longitudinal axis of said prong.

4. A unitary resilient stacking wire as set forth in claim 1, the end portion of each said leg, adjacent its respective foot, including an inwardly directed protrusion extending therefrom, said protrusions lying substantially within the plane of said legs and said bight postion and being adapted to co-act with a tray and the like to maintain the plane of said legs and said bight portion in a vertical orientation, and each said prong terminating with an end face lying in a plane substantially perpendicular to the longitudinal axis of said prong.

* * * * *